US005884891A

United States Patent [19]

Hawkins et al.

[11] Patent Number: 5,884,891

[45] Date of Patent: Mar. 23, 1999

[54] SUSPENSION SYSTEM FOR WASHING MACHINE

[75] Inventors: Larry Lee Hawkins, Louisville; Stephen Bernard Froelicher, Shepherdsville, both of Ky.

[73] Assignee: General Electric Company, Louisville, Ky.

[21] Appl. No.: 732,772

[22] Filed: Oct. 15, 1996

[51] Int. Cl.[6] ..... D06F 37/20

[52] U.S. Cl. ..... 248/613; 68/23.3; 248/288.31; 248/638

[58] Field of Search ..... 248/613, 581, 248/638, 288.31; 403/114, 122, 128; 68/35.3

[56] References Cited

U.S. PATENT DOCUMENTS

| | | | |
|---|---|---|---|
| 2,467,639 | 4/1949 | Tornblom | 403/114 X |
| 2,693,372 | 11/1954 | Ludwig et al. | 403/114 |
| 2,711,297 | 6/1955 | Thiele | 248/638 X |
| 3,306,082 | 2/1967 | Hasegawa et al. . | |
| 3,744,746 | 7/1973 | Weir et al. . | |
| 4,423,608 | 1/1984 | Funaki . | |
| 4,537,382 | 8/1985 | Beck | 68/23.3 X |
| 4,625,529 | 12/1986 | Anderson . | |
| 5,083,845 | 1/1992 | Sparks et al. . | |
| 5,117,659 | 6/1992 | Sharp et al. . | |

FOREIGN PATENT DOCUMENTS

| | | | |
|---|---|---|---|
| 137567 | 12/1978 | Japan | 68/23.3 |
| 1085989 | 5/1986 | Japan | 68/23.3 |
| 1213093 | 9/1986 | Japan | 68/23.3 |
| 3194697 | 8/1988 | Japan | 68/23.3 |

*Primary Examiner*—Derek J. Berger
*Attorney, Agent, or Firm*—H. Neil Houser

[57] ABSTRACT

An easy to assemble upper ball joint assembly for a wash tub suspension system is described. In accordance with one embodiment, the upper ball joint assembly includes a socket configured to be located within a keyed opening in the suspension system upper frame, and a ball joint configured to be secured to a suspension rod extending from the suspension system lower frame through the opening in the upper frame. The socket includes a seating surface which, in one embodiment, is substantially spherical shaped and concave. A slot extends from the socket opening to a periphery of the socket. The slot is configured so that the suspension rod can be moved through the slot and located within the socket opening. By orienting the socket so that the slot extends radially outward from a center axis of the wash tub, the suspension rod is allowed more movement relative to the socket since the rod can also move within the slot. The ball joint has a seating surface for mating with the socket seating surface, and the ball joint seating surface is substantially spherical shaped and convex. The ball joint further includes a substantially cylindrical central support member. A support flange extends from a periphery of the ball joint seating surface, and a plurality of support members extend from the support flange to the substantially cylindrical central support member. The suspension rod extends through an opening in the ball joint, which opening includes a bore extending through the central support member, and an end of suspension rod is deformed, or crimped, so that the ball joint is trapped between the end of suspension rod and the socket.

18 Claims, 1 Drawing Sheet

SUSPENSION SYSTEM FOR WASHING MACHINE

FIELD OF THE INVENTION

This invention relates generally to washing machines and, more particularly, to a suspension system for wash tub.

BACKGROUND OF THE INVENTION

Known washing machines include a suspension system for suspending a wash tub, a basket, a motor, and a transmission, and clothes and water loads, within a cabinet, and for damping movement of the wash tub and basket. Known suspension systems include an upper frame and a lower frame. The upper frame is secured to, and supported by, the cabinet. The lower frame is coupled to the upper frame, and the lower frame is movable relative to the upper frame. The wash tub, basket, motor and transmission are coupled to the lower frame.

In one known configuration, suspension rods extend from the lower frame to the upper frame. The suspension rods are secured, at first ends, to cylinder and piston assemblies mounted to the lower frame so that the lower frame can move relative to the suspension rods. Allowing the lower frame to move relative to the suspension rods facilitates damping wash tub and basket movement.

The suspension rods are secured, at second ends, to the upper frame. In one known embodiment, plastic ball joints having longitudinal slots are snap fit to respective rods. The ball joints are positioned on respective seats in the upper frame. The tight fit between the ball joints and the suspension rods prevents the rods from moving longitudinally relative to the ball joints.

With the above described configuration, the ball joint slot dimensions typically must be within relatively tight tolerances so that the ball joint fits tightly with the suspension rod to avoid early failure of the rod. For example, if a snap fit is too loose, a suspension rod could move relative to a ball joint, and such movement can result in early failure of the rod. The fit between the rod and ball joint cannot be too tight, however, because such a tight fit can result in assembly difficulties. Particularly, if the fit between the ball joint and the rod is too tight, it may be very difficult, if not impossible, to snap the ball joint onto the suspension rod.

The relatively tight tolerance requirements of the above described ball joint also adds cost to washing machine assembly. Specifically, any ball joint that does not satisfy the tolerance requirements is not used. Further, if the ball joint is molded, the mold used in the molding process must be precisely machined to satisfy the tolerance requirements. Such machining often requires a skilled and experienced machine operator. In addition, over time, the mold can wear and the relatively tight tolerance requirements for ball joints molded using the mold may not be satisfied. Under such circumstances, the ball joint may fit more loosely than desired with the suspension rod. As explained above, such a loose fit can result in early failure of the suspension rod.

In addition to the assembly difficulties described above, the ball joint also is difficult to disassemble from the suspension rod. Particularly, during servicing, it may be necessary to remove the ball joints from the suspension rods in order to remove the wash tub or other components from within the cabinet. Due to the tight fit between the ball joint and rod, however, it may be extremely difficult to remove the ball joint from the rod.

It would be desirable to provide an upper ball joint assembly for a washing machine suspension assembly that is relative simple and easy to assemble and disassemble. It also would be desirable to provide such an upper ball joint assembly that does not require relatively tight manufacturing tolerances.

SUMMARY OF THE INVENTION

These and other objects may be attained in a suspension system including an easy to assemble and disassemble upper ball joint assembly. In accordance with one embodiment of the present invention, the upper ball joint assembly includes a socket configured to be located within a keyed opening in the suspension system upper frame, and the socket includes a seating surface which, in one embodiment, is substantially spherical shaped and concave. The socket further includes a substantially cylindrical shaped support leg configured to contact an upper surface of the upper frame, and an alignment extension flange for facilitating orientation of the socket within the upper frame opening.

The socket also includes an opening extending substantially coaxially with the seating surface, and a slot extends from the opening to a periphery of the socket. The slot is configured so that the support rod can be moved through the slot and located within the socket opening. By orienting the socket so that the slot extends radially outward from a center axis of the wash tub, the suspension rod is allowed additional movement relative to the socket since the rod can also move within the slot. Such added allowable movement of the suspension rod further facilitates damping movements of the wash tub and basket.

The upper ball joint assembly also includes a ball joint having a seating surface for mating with the socket seating surface. The ball joint seating surface is substantially spherical shaped and convex. The ball joint further includes a substantially cylindrical central support member. A support flange extends from a periphery of the ball joint seating surface, and a plurality of support members extend from the support flange to the substantially cylindrical central support member.

The suspension rod extends through an opening in the ball joint, which opening includes a bore extending through the central support member. The suspension rod also extends through a steel washer in substantial surface to surface contact with an upper end surface of the central support member. The steel washer facilitates more even distribution of forces transferred from the suspension rod to the ball joint. An end of support rod is deformed, or crimped, so that the end of suspension rod cannot pass through the ball joint. Also, the suspension rod is deformed, or squeezed, to form a squeeze area having surfaces that form a snug fit with the ball joint to hold the ball joint in place during assembly and prevent relative movement between the suspension rod and the ball joint during operation.

The above described upper ball joint assembly allows movement of the upper ball joint and the suspension rod relative to the socket. By allowing such relative movement, the ball joint assembly facilitates wash tub and basket movement relative to the cabinet, which results in reduced forces on the cabinet and therefore facilitates preventing undesired movement of the cabinet during washing machine operations. Further, the upper ball joint assembly is easy and simple to assemble and disassemble, and there is no need for tight, or relatively tight tolerances, which further simplifies manufacturing.

DETAILED DESCRIPTION OF THE DRAWINGS

Figure 1:
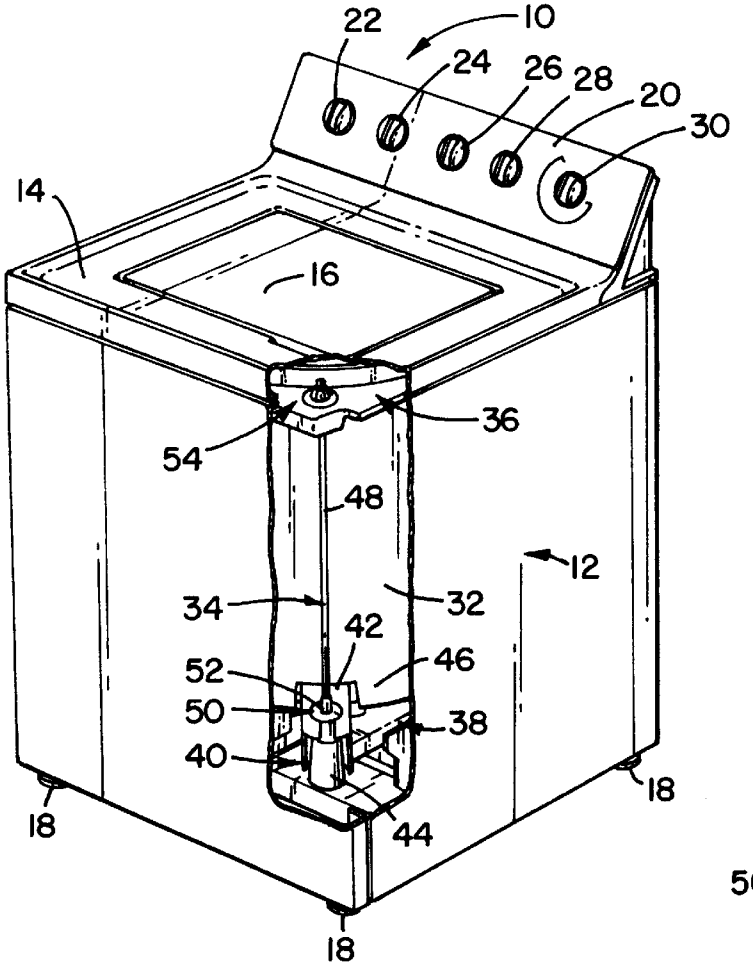
FIG. 1 is a perspective view of a washing machine with parts cut away.

FIG. 1 is a perspective view of an exemplary washing machine 10 with parts cut away. Washing machine 10 is shown for illustrative purposes only and not by way of limitation. The present suspension system can be utilized in connection with many other washing machines. Washing machine 10 includes a cabinet 12 having a washer cover 14, and a lid 16 is pivotally mounted to washer cover 14. Supports 18 are secured to cabinet. Machine 10 also includes a control panel 20 having washing control knobs 22, 24, 26 and 28 and a timer knob 30.

A wash tub 32 is mounted within cabinet 12, and wash tub 32 is supported by a suspension system 34 including an upper frame 36 and a lower frame 38 movable relative to upper frame 36. Wash tub 32 is secured to lower frame 38, and therefore, wash tub 32 also is movable relative to upper frame 36. Upper frame 36 is secured to cabinet 12, and loads associated with tub 32, a basket, a motor, and a transmission, and clothes and water loads, are supported by cabinet 12 through suspension system 34. Washing machine 10 may, for example, be washing machine model number WWSR3090T, commercially available from General Electric Company, Appliance Park, Louisville, Ky. 40225. In accordance with the present invention, such washing machine would be modified to include the upper ball joint assembly described below in more detail.

To damp wash tub and basket movement, system 34 also includes a piston and cylinder assembly 40 mounted to lower frame 38. More specifically, at each corner 42 of lower frame 38 (only one of four corners 42 of lower frame 38 is shown in FIG. 1) a cylinder 44 is secured to a brace 46 of lower frame 38. A spring biased piston (not shown) is located within cylinder 44, and the piston is secured to a suspension, or support, rod 48. A lower ball joint assembly 50 is coupled to an extension 52 of lower brace 46 and is supported by cylinder 44. Suspension rod 48 extends through cylinder 44 to the piston. Suspension rod 48 also extends through an opening (not shown) in upper frame 36, and suspension rod 48 is secured to an upper ball joint assembly 54 at upper frame 36.

Suspension system 34 facilitates damping movement of wash tub 32 during operation of washing machine 10. Specifically, since lower frame 38 is movable relative to upper frame 36, lower frame 38 damps movement of tub 32. In addition, since suspension rod 48 also is movable relative to upper frame 36, suspension rod 48 also damps wash tub movement.

Figure 2:
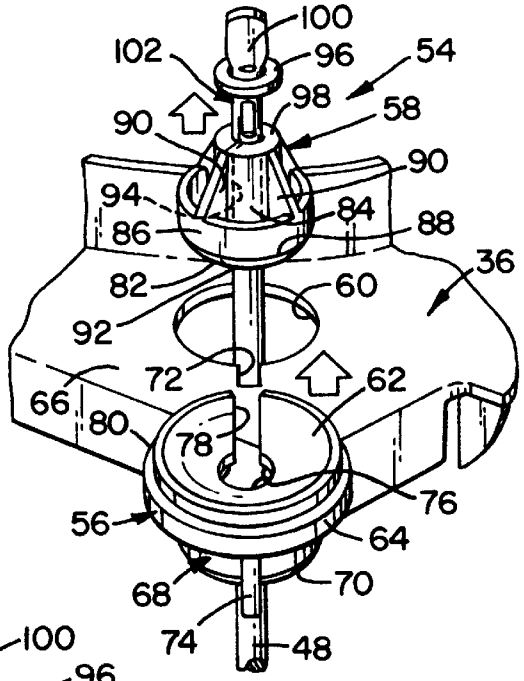
FIG. 2 is an exploded view of an upper ball joint assembly and frame of the washing machine illustrated in FIG. 1.

Easy to assemble and disassemble upper ball joint assembly 54 is shown in more detail in FIG. 2. More specifically. FIG. 2 is an exploded view of upper ball joint assembly 54 and upper frame 36 illustrated in FIG. 1. Upper ball joint assembly 54 includes a socket 56 and a ball joint 58. Socket 56 is configured to be located within a keyed opening 60 in upper frame 36, and socket 56 includes a seating surface 62 which, in the embodiment shown in FIG. 2, is substantially spherical shaped and concave. Socket 56 further includes a substantially cylindrical shaped support leg 64 configured to contact an upper surface 66 of upper frame 36, and an alignment extension flange 68 including a tapered portion 70 for facilitating orientation of socket 56 within upper frame opening 60. Specifically, upper frame opening 60 includes a keyed cut-out portion 72, and socket alignment extension flange 68 includes a key extension 74 configured to be located within keyed cut-out portion 72 of upper frame opening 60. With key extension 74 located within keyed cut-out portion 72, socket 56 is aligned in a desired orientation, as explained below in more detail. Flange 68 and key extension 74 can, of course, have many alternative geometric shapes. For example, flange 68 could be in the form of circular projections, cone shaped tips, or fingers which extend into opening 60.

Socket 56 also includes an opening 76 extending substantially coaxially with seating surface 62, and a slot 78 extends from opening 76 to a periphery 80 of socket 56. Slot 78 is configured so that rod 48 can be moved through slot 78 and located within socket opening 76. In one embodiment, socket 56 is molded using a polymeric material such as nylon.

Ball joint 58 has a seating surface 82 for mating with socket seating surface 82. Ball joint seating surface 82 is substantially spherical shaped and convex. Ball joint 58 further includes a substantially cylindrical central support member 84. A support flange 86 extends from a periphery 88 of ball joint seating surface 82, and a plurality of support members 90 extend from support flange 86 to substantially cylindrical central support member 84. In one embodiment, ball joint 58 is molded from a polymeric material such as acetal.

Suspension rod 48 extends through an opening 92 in ball joint 58, which opening includes a bore 94 extending through central support member 84. Suspension rod 48 also extends through a steel washer 96 in substantial surface to surface contact with an upper end surface 98 of central support member 84. Steel washer 96 facilitates more even distribution of forces from suspension rod 48 to ball joint 58. An end 100 of support rod 48 is deformed, or crimped, so that steel washer 96 on end 100 of suspension rod 48 cannot pass through bore 94. Also, suspension rod 48 is deformed, or squeezed, to form a squeeze area 102 so that surfaces of suspension rod 48 and steel washer 96 are in tight fit with ball joint 58 to prevent relative movement between suspension rod 48, steel washer 96, and ball joint 58.

Figure 3:
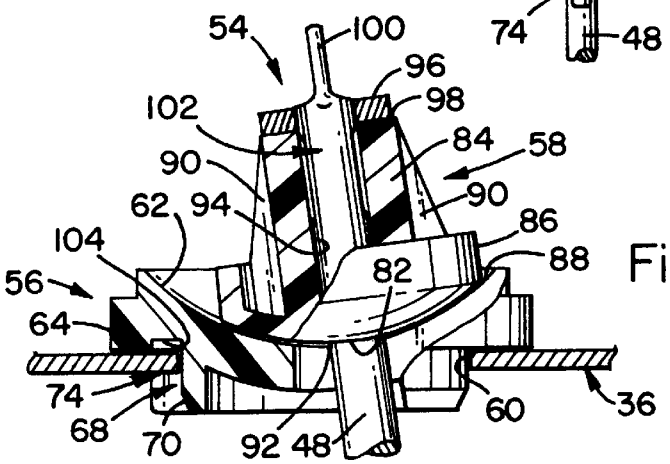
FIG. 3 is a partial cross section view of the upper ball joint assembly and frame shown in FIG. 2.

Referring to FIG. 3, which is a partial cross section view of upper ball joint assembly 54 and upper frame 36 shown in FIG. 2, a gap 104 is formed between support leg 64 and alignment extension flange 68. Gap 104 provides a tolerance for the dimensions of opening 60 so that upper frame 36 does not cut into flange 68. In addition, and as shown in FIG. 3, ball joint seating surface 82 mates with socket seating surface 62, and ball joint 58 is movable relative to socket 56. Slot 78 (FIG. 2) allows location of suspension rod within the central axis of socket opening 76.

By allowing movement of upper ball joint 58 and suspension rod 48 relative to socket 56, ball joint assembly 54 facilitates motion of wash tub 32. Such freedom of movement results in reduced forces on cabinet 12, and therefore facilitates preventing undesired movement of cabinet 12 during washing machine operations.

In addition to isolating wash tub forces, upper ball joint assembly 54 is easy and simple to assemble and disassemble. Specifically, and prior to assembly to a washing machine, ball joint 58 is located on suspension rod 48 by passing suspension rod 48 through opening 92 in ball joint 58. Washer 96 is then inserted on suspension rod 48 and located in surface to surface contact with upper end surface 98 of central support member 84, and end 100 of suspension rod 48 is deformed so that ball joint 58 is trapped between end 100 of suspension rod 48 and socket 56.

With ball joint 58 so assembled to rod 48, ball joint 58 is then inserted through opening 60 in upper frame 36 so that ball joint 58 is spaced above the upper surface of upper frame 36. Socket 56 is then inserted in upper frame opening 60 by locating socket key 74 in keyed cut-out portion 72 and by sliding suspension rod 48 through socket slot 78 so that suspension rod 48 is positioned in socket opening 76. Ball joint 58 is then lowered so that ball joint seating surface 82 seats on socket seating surface 62.

The above described assembly process is simple and easy to perform and can be completed quickly in a manufacturing setting. In addition, there is no need for relatively tight tolerances, which further simplifies manufacturing. Also, disassembly is simple and easy. Specifically, by lifting wash tub 32, a clearance space is provided between socket 56 and ball joint 58, and once wash tub 32 is lifted to a sufficient height, socket 56 can be removed from opening 60. Wash tub 32 is then lowered, and as wash tub 32 is lowered, ball joint 58 passes through opening 60 in upper frame 36. In this manner, wash tub 32 and other components can easily be removed from within cabinet 12.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. An upper ball joint assembly for a washing machine including an upper frame having an upper surface and a lower frame, the lower frame being movable relative to the upper frame, and a suspension rod coupled to the lower frame and extending through an opening in the upper frame, said upper ball joint assembly comprising:

a removable socket for being supported on the upper surface of the upper frame and comprising an alignment extension flange configured to at least partially extend through the opening in the upper frame, said socket comprising a seating surface and having an opening therethrough, a slot extending from said socket opening to a periphery of said socket, said slot configured so that the suspension rod can be moved through said slot and located within said socket opening; and a ball joint comprising a seating surface for mating with said socket seating surface and having an opening therethrough so that the suspension rod can extend through said ball joint.

2. A ball joint assembly in accordance with claim 1 wherein said socket alignment extension flange comprises a key extension.

3. A ball joint assembly in accordance with claim 1 wherein said socket further comprises a support leg.

4. A ball joint assembly in accordance with claim 1 wherein said socket seating surface is substantially spherical shaped and is concave, and said socket further comprises a substantially cylindrical shaped support leg which extends beyond a periphery of said seating surface and is configured to contact the upper surface of the upper frame.

5. A ball joint assembly in accordance with claim 1 wherein said socket is nylon.

6. A ball joint assembly in accordance with claim 1 wherein said ball joint further comprises a substantially cylindrical central support member, and said ball joint opening comprises a bore extending through said central support member.

7. A ball joint assembly in accordance with claim 6 wherein said ball joint further comprises a support flange extending from a periphery of said ball joint seating surface, and a plurality of support members extending from said support flange to said substantially cylindrical central support member.

8. A ball joint assembly in accordance with claim 6 further comprising a washer located at an upper end of said substantially cylindrical central support member.

9. A ball joint assembly in accordance with claim 1 wherein said ball joint seating surface is substantially spherical shaped and is convex.

10. A ball joint assembly in accordance with claim 1 wherein said ball joint is acetal.

11. An upper ball joint assembly for a suspension system for a wash tub of a washing machine, the suspension system including an upper frame having an upper surface and a lower frame movable relative to the upper frame, the wash tub secured to the lower frame, a piston and cylinder assembly located at the lower frame, a suspension rod coupled to the piston and cylinder assembly and extending from the piston and cylinder assembly through an opening in the upper frame, said upper ball joint assembly comprising:

a removable socket for being supported on the upper surface of the upper frame and configured to at least partially extend through the opening in the upper frame, said socket comprising a seating surface and having an opening therethrough, a slot extending from said socket opening to a periphery of said socket, said slot configured so that the suspension rod can be moved through said slot and located within said socket opening, said socket seating surface being substantially spherical shaped and concave, said socket further comprising a support leg configured to contact the upper surface of the upper frame; and a ball joint comprising a seating surface for mating with said socket seating surface and having an opening therethrough so that the suspension rod can extend through said ball joint, said ball joint seating surface being substantially spherical shaped and convex, said ball joint further comprising a vertically extending central support member.

12. A ball joint assembly in accordance with claim 11 wherein said socket further comprises an alignment extension flange for facilitating orientation of said socket within the upper frame opening.

13. A ball joint assembly in accordance with claim 12 wherein said socket alignment extension flange comprises a key extension.

14. A ball joint assembly in accordance with claim 11 wherein said ball joint further comprises a support flange extending from a periphery of said ball joint seating surface, and a plurality of support members extending from said support flange to said central support member.

15. A ball joint assembly in accordance with claim 11 further comprising a washer located at an upper end of said central support member.

16. A washing machine comprising a cabinet, a lower frame and an upper frame mounted within the cabinet, said upper frame having an upper surface and spaced from said lower frame and said lower frame being movable relative to said upper frame, a suspension rod coupled to said lower frame and extending through an opening in said upper frame, and an upper ball joint assembly comprising a removable socket supported on said upper surface of said upper frame and comprising an alignment extension flange extending at least partially through said opening in said upper frame, said socket comprising a seating surface and having an opening therethrough, a slot extending from said socket opening to a periphery of said socket, said slot configured so that said suspension rod can be moved through said slot and located within said socket opening, said upper ball joint assembly further comprising a ball joint comprising a seating surface seated on said socket seating surface and having an opening therethrough, said suspension rod extending through said ball joint.

17. A washing machine in accordance with claim 16 wherein said upper frame opening includes a keyed cut-out portion, and wherein said alignment extension flange comprises a key extension located within said keyed cut-out portion of said upper frame opening.

18. A washing machine in accordance with claim 16 wherein said socket seating surface is substantially spherical shaped and is concave, and said socket further comprises a substantially cylindrical shaped support leg which extends beyond a periphery of said seating surface and is configured to contact said upper surface of said upper frame.

* * * * *